US009275531B2

(12) United States Patent
Soto et al.

(10) Patent No.: US 9,275,531 B2
(45) Date of Patent: Mar. 1, 2016

(54) SYSTEMS AND METHODS FOR ADAPTIVELY CONTROLLING ALARM ISSUANCE

(71) Applicants: Manuel Soto, Lake Worth, FL (US); Adam S. Bergman, Boco Raton, FL (US)

(72) Inventors: Manuel Soto, Lake Worth, FL (US); Adam S. Bergman, Boco Raton, FL (US)

(73) Assignee: Tyco Fire & Security GmbH, Rheinfall (CH)

( * ) Notice: Subject to any disclaimer, the term of this patent is extended or adjusted under 35 U.S.C. 154(b) by 0 days.

(21) Appl. No.: 14/485,030

(22) Filed: Sep. 12, 2014

(65) Prior Publication Data

US 2016/0035197 A1 Feb. 4, 2016

Related U.S. Application Data

(60) Provisional application No. 62/011,442, filed on Jun. 12, 2014.

(51) Int. Cl.

| | |
|---|---|
| ***G08B 13/14*** | (2006.01) |
| ***G08B 13/24*** | (2006.01) |
| ***G08B 29/18*** | (2006.01) |

(52) U.S. Cl.

CPC ..... *G08B 13/2482* (2013.01); *G08B 13/2451* (2013.01); *G08B 29/185* (2013.01)

(58) Field of Classification Search

CPC ..... G08B 13/2482; G08B 13/2461; G08B 29/185

See application file for complete search history.

(56) References Cited

U.S. PATENT DOCUMENTS

| | | | | |
|---|---|---|---|---|
| 4,510,489 | A | 4/1985 | Anderson, III et al. | |
| 4,510,490 | A | 4/1985 | Anderson, III et al. | |
| 6,307,473 | B1 | 10/2001 | Zampini et al. | |
| 7,372,364 | B2 * | 5/2008 | Mercer | G06K 7/0008 340/10.1 |
| 7,994,918 | B2 * | 8/2011 | Lai | G08B 13/1427 340/10.2 |
| 2008/0278320 | A1 | 11/2008 | Soto et al. | |
| 2011/0109456 | A1 | 5/2011 | Bergman et al. | |
| 2012/0075101 | A1 | 3/2012 | Austin et al. | |
| 2013/0169413 | A1 * | 7/2013 | Schuessler | G08B 13/2417 340/10.1 |
| 2014/0111338 | A1 | 4/2014 | Bergman et al. | |

* cited by examiner

*Primary Examiner* — Van Trieu

(74) *Attorney, Agent, or Firm* — Robert J. Sacco; Carol E. Thorstad-Forsyth; Fox Rothschild LLP

(57) ABSTRACT

Systems (100) and methods (600-900) for adaptively controlling a transmitter field in an EAS detection system. The methods comprise: detecting the presence of a first person located in proximity to a first pedestal of the EAS detection system using a first proximity sensor disposed on the first pedestal; determining a first distance value representing a distance from the first pedestal to the first person whose presence was previously detected using distance information obtained from the first proximity sensor; using the first distance value to select a criteria for use in determining whether the alarm issuance should be inhibited; and adaptively controlling the alarm issuance if the criteria which was previously selected is met based at least on a first amplitude of a security tag signal received at the first pedestal.

20 Claims, 10 Drawing Sheets

Go To IG. 8B

SYSTEMS AND METHODS FOR ADAPTIVELY CONTROLLING ALARM ISSUANCE

CROSS REFERENCE TO RELATED APPLICATIONS

This application claims the benefit of U.S. Provisional Patent Application No. 62/011,442 filed Jun. 12, 2014, the entirety of which is incorporated herein by reference.

BACKGROUND OF THE INVENTION

1. Statement of the Technical Field

The present invention relates generally to Electronic Article Surveillance ("EAS") detection systems. More particularly, the present invention relates to implementing systems and methods for adaptively controlling alarm issuance.

2. Description of the Related Art

EAS detection systems generally comprise an interrogation antenna for transmitting an electromagnetic signal into an interrogation zone, markers which respond in some known electromagnetic manner to the interrogation signal, an antenna for detecting the response of the marker, a signal analyzer for evaluating the signals produced by the detection antenna, and an alarm which indicates the presence of a marker in the interrogation zone. The alarm can then be the basis for initiating one or more appropriate responses depending upon the nature of the facility. Typically, the interrogation zone is in the vicinity of an exit from a facility such as a retail store, and the markers can be attached to articles such as items of merchandise or inventory.

One type of EAS detection system utilizes AcoustoMagnetic ("AM") markers. The general operation of an AM EAS detection system is described in U.S. Pat. Nos. 4,510,489 and 4,510,490, the disclosure of which is herein incorporated by reference. The detection of markers in an AM EAS detection system by pedestals placed at an exit has always been specifically focused on detecting markers only within the spacing of the pedestals. However, the interrogation field generated by the pedestals may extend beyond the intended detection zone. For example, a first pedestal will generally include a main antenna field directed toward a detection zone located between the first pedestal and a second pedestal. When an exciter signal is applied at the first pedestal it will generate an electro-magnetic field of sufficient intensity so as to excite markers within the detection zone. Similarly, the second pedestal will generally include an antenna having a main antenna field directed toward the detection zone (and toward the first pedestal). An exciter signal applied at the second pedestal will also generate an electromagnetic field with sufficient intensity so as to excite markers within the detection zone. When a marker tag is excited in the detection zone, it will generate an electromagnetic signal which can usually be detected by receiving the signal at the antennas associated with the first and second pedestal.

One limitation of EAS detection systems is the detection of tagged items in the back-field area behind the pedestal antennas. Tag detection in this area will trigger alarms that are considered false, since the customer carrying the merchandise is not exiting the store. One method used to reduce back-field is to change the antenna's transmit and receive patterns from transceivers (transmit and receive simultaneously) to transmit or receive only. This method is effective in reducing back-field alarms. However, this method reduces the systems performance in the valid detection area. Other methods which compare received amplitudes between multiple antennas have been successful in reducing back-field false alarms. But, these algorithms could be unreliable due to their dependence on noise amplitudes.

SUMMARY OF THE INVENTION

The present invention concerns implementing systems and methods for adaptively in inhibiting back-field alarms. The methods comprise: detecting the presence of a first person located in proximity to a first pedestal of the EAS detection system using a first proximity sensor disposed on the first pedestal; determining a first distance value representing a distance from the first pedestal to the first person using distance information obtained from the first proximity sensor; using the first distance value to select a criteria for use in determining whether the alarm issuance should be inhibited; and adaptively controlling the alarm issuance if the criteria is met based at least on a first amplitude of a security tag signal received at the first pedestal.

In some scenarios, the criteria comprises an expected range of values for the first amplitude of the security tag signal emitted from a security tag located about the same distance from the first pedestal as the first person. Accordingly, the first distance value is used to select a minimum amplitude threshold value and a maximum amplitude threshold value from a plurality of pre-defined amplitude threshold values. The criteria is met when the first amplitude of the security tag signal is (1) greater than or equal to the minimum amplitude threshold value and (2) less than or equal to the maximum amplitude threshold value.

In other scenarios, the criteria comprises an expected range of values for a ratio between the first amplitude and a second amplitude of the security tag signal received at a second pedestal of the EAS detection system. As such, the first distance value is used to select a minimum ratio threshold value and a maximum ratio threshold value from a plurality of pre-defined ratio threshold values. The criteria is met when a ratio between the first and second amplitudes is (1) greater than or equal to the minimum ratio threshold value and (2) less than or equal to the maximum ratio threshold value.

In those or other scenarios, the methods further comprise: detecting the presence of the first person located in proximity to a second pedestal of the EAS detection system using a second proximity sensor disposed on the second pedestal; and determining a second distance value representing a distance from the first pedestal to the first person whose presence was previously detected using distance information obtained from the second proximity sensor. Either the first or second distance value is selected when the first and second distance values are the same. Alternatively, one of the first and second distance values is selected when the first and second distance values are not the same. As such, the criteria can be selected using the first or second distance value which was previously selected.

Validation operations can also be performed. The validation operations involve validating that the security tag is possessed by the first person using an amplitude ratio between the first amplitude and a second amplitude of the security tag signal received at a second pedestal of the EAS detection system.

In those and yet other scenarios, the methods further comprise: detecting the presence of a second person located in proximity to the first pedestal of the EAS detection system using a second proximity sensor disposed on the first pedestal; determining whether at least one of the first person and the second person is located in a back-field of the first pedestal's antenna; and using distance information associated with the first or second person which was determined to be located in the back-field of the first pedestal's antenna to adaptively control the alarm issuance.

BRIEF DESCRIPTION OF THE DRAWINGS

Embodiments will be described with reference to the following drawing figures, in which like numerals represent like items throughout the figures, and in which.

DETAILED DESCRIPTION OF THE INVENTION

Figure 1:
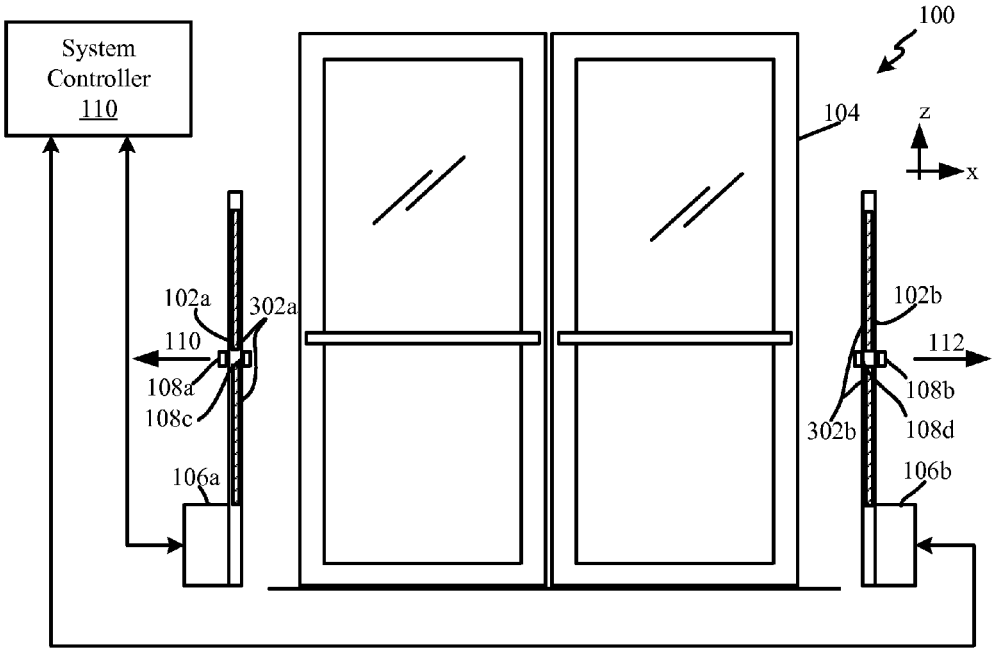
FIG. 1 is a side view of an EAS detection system.

It will be readily understood that the components of the embodiments as generally described herein and illustrated in the appended figures could be arranged and designed in a wide variety of different configurations. Thus, the following more detailed description of various embodiments, as represented in the figures, is not intended to limit the scope of the present disclosure, but is merely representative of various embodiments. While the various aspects of the embodiments are presented in drawings, the drawings are not necessarily drawn to scale unless specifically indicated.

The present invention may be embodied in other specific forms without departing from its spirit or essential characteristics. The described embodiments are to be considered in all respects only as illustrative and not restrictive. The scope of the invention is, therefore, indicated by the appended claims rather than by this detailed description. All changes which come within the meaning and range of equivalency of the claims are to be embraced within their scope.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussions of the features and advantages, and similar language, throughout the specification may, but do not necessarily, refer to the same embodiment.

Furthermore, the described features, advantages and characteristics of the invention may be combined in any suitable manner in one or more embodiments. One skilled in the relevant art will recognize, in light of the description herein, that the invention can be practiced without one or more of the specific features or advantages of a particular embodiment. In other instances, additional features and advantages may be recognized in certain embodiments that may not be present in all embodiments of the invention.

Reference throughout this specification to "one embodiment", "an embodiment", or similar language means that a particular feature, structure, or characteristic described in connection with the indicated embodiment is included in at least one embodiment of the present invention. Thus, the phrases "in one embodiment", "in an embodiment", and similar language throughout this specification may, but do not necessarily, all refer to the same embodiment.

As used in this document, the singular form "a", "an", and "the" include plural references unless the context clearly dictates otherwise. Unless defined otherwise, all technical and scientific terms used herein have the same meanings as commonly understood by one of ordinary skill in the art. As used in this document, the term "comprising" means "including, but not limited to".

The present invention generally provides implementing systems and methods for adaptively controlling alarm issuance in an EAS detection system. If a person is located in a back-field of a pedestal antenna and has possession of an object with a security tag attached thereto, then the distance from the pedestal's antenna to the person is correlated with an expected amplitude range for a security tag signal. For example, such correlation is achieved by determining whether or not the amplitude of the security tag signal falls within an expected range of amplitudes for a security tag which is located a specific distance from the pedestal antenna. In this case, confirmation is obtained that the person does in fact have possession of the object with the security tag affixed thereto. If the person is located in the back-field of the pedestal's antenna, then issuance of an alarm is inhibited. Consequently, the EAS detection system experiences power savings and a reduction in back-field detection as compared to that of conventional EAS detection systems.

Notably, the location of the person can be determined using proximity sensors (e.g., ultrasonic transducers, laser sensors, and infrared sensors) mounted on the pedestals of the EAS detection system. Proximity sensors are well known in the art, and therefore will not be described herein. Any known or to be known proximity sensor can be used herein without limitation.

Figure 2:
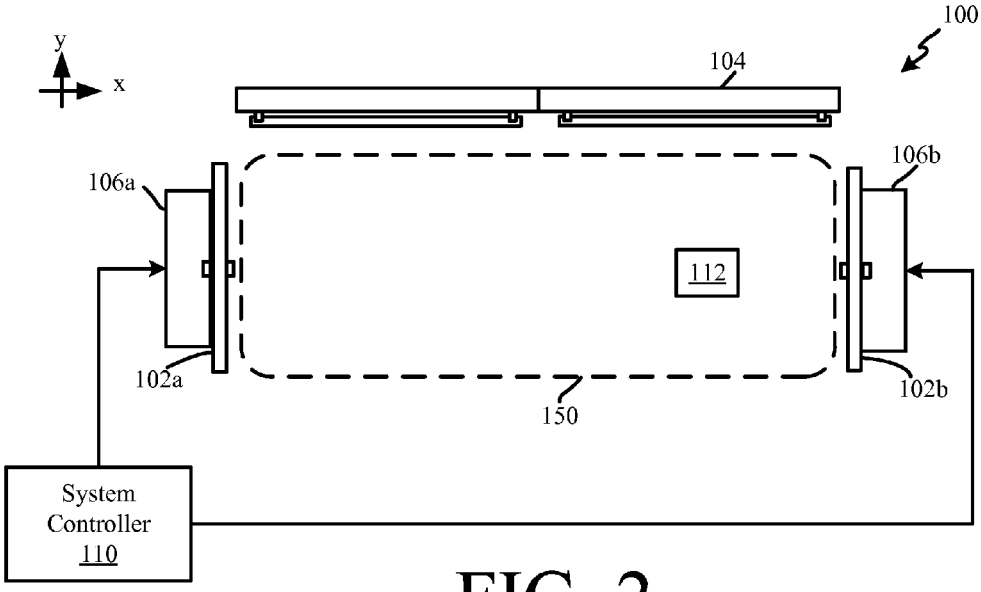
FIG. 2 is a top view of the EAS detection system in FIG. 1, which is useful for understanding an EAS detection zone thereof.

Referring now to FIGS. 1 and 2, an exemplary architecture for an EAS detection system 100 is provided. Notably, the present invention is described herein in terms of an AM EAS detection system. However, the method of the invention can also be used in other types of EAS detection systems, including systems that use Radio Frequency ("RF") type tags and Radio Frequency IDentification ("RFID") EAS detection systems.

The EAS detection system 100 will be positioned at a location adjacent to an entry/exit 104 of a secured facility (e.g., a retail store). The EAS detection system 100 uses specially designed EAS marker tags ("security tags") which are applied to store merchandise or other items which are stored within a secured facility. The security tags can be deactivated or removed by authorized personnel at the secure facility. For example, in a retail environment, the security tags could be removed by store employees. When an active security tag 112 is detected by the EAS detection system 100 in an idealized representation of an EAS detection zone 150 near the entry/exit, the EAS detection system will detect the presence of such security tag and will sound an alarm or generate some other suitable EAS response. Accordingly, the EAS detection system 100 is arranged for detecting and preventing the unauthorized removal of articles or products from controlled areas.

The EAS detection system 100 includes a pair of pedestals 102*a*, 102*b*, which are located a known distance apart (e.g., at opposing sides of an entry/exit 104). The pedestals 102*a*, 102*b* are typically stabilized and supported by a base 106*a*, 106*b*. The pedestals 102*a*, 102*b* will each generally include one or more antennas that are suitable for aiding in the detection of the special EAS security tags, as described herein. For example, pedestal 102*a* can include at least one antenna 302 suitable for transmitting or producing an electromagnetic exciter signal field and receiving response signals generated by security tags in the EAS detection zone 150. In some embodiments, the same antenna can be used for both receive and transmit functions. Similarly, pedestal 102*b* can include at least one antenna 402 suitable for transmitting or producing an electromagnetic exciter signal field and receiving response signals generated by security tags in the EAS detection zone 150. The antennas provided in pedestals 102*a*, 102*b* can be conventional conductive wire coil or loop designs as are commonly used in AM type EAS pedestals. These antennas will sometimes be referred to herein as exciter coils. In some embodiments, a single antenna can be used in each pedestal. The single antenna is selectively coupled to the EAS receiver. The EAS transmitter is operated in a time multiplexed manner. However, it can be advantageous to include two antennas (or exciter coils) in each pedestal as shown in FIG. 1, with an upper antenna positioned above a lower antenna.

The antennas located in the pedestals 102*a*, 102*b* are electrically coupled to a system controller 110. The system controller 110 controls the operation of the EAS detection system 100 to perform EAS functions as described herein. The system controller 110 can be located within a base 106*a*, 106*b* of one of the pedestals 102*a*, 102*b* or can be located within a separate chassis at a location nearby to the pedestals. For example, the system controller 110 can be located in a ceiling just above or adjacent to the pedestals 102*a*, 102*b*.

As noted above, the EAS detection system comprises an AM type EAS detection system. As such, each antenna is used to generate an Electro-Magnetic ("EM") field which serves as a security tag exciter signal. The security tag exciter signal causes a mechanical oscillation of a strip (e.g., a strip formed of a magnetostrictive or ferromagnetic amorphous metal) contained in a security tag within an EAS detection zone 150. As a result of the stimulus signal, the security tag will resonate and mechanically vibrate due to the effects of magnetostriction. This vibration will continue for a brief time after the stimulus signal is terminated. The vibration of the strip causes variations in its magnetic field, which can induce an AC signal in the receiver antenna. This induced signal is used to indicate a presence of the strip within the EAS detection zone 150. As noted above, the same antenna contained in a pedestal 102*a*, 102*b* can serve as both the transmit antenna and the receive antenna. Accordingly, the antennas in each of the pedestals 102*a*, 102*b* can be used in several different modes to detect a security tag exciter signal. These modes will be described below in further detail.

Figure 3:
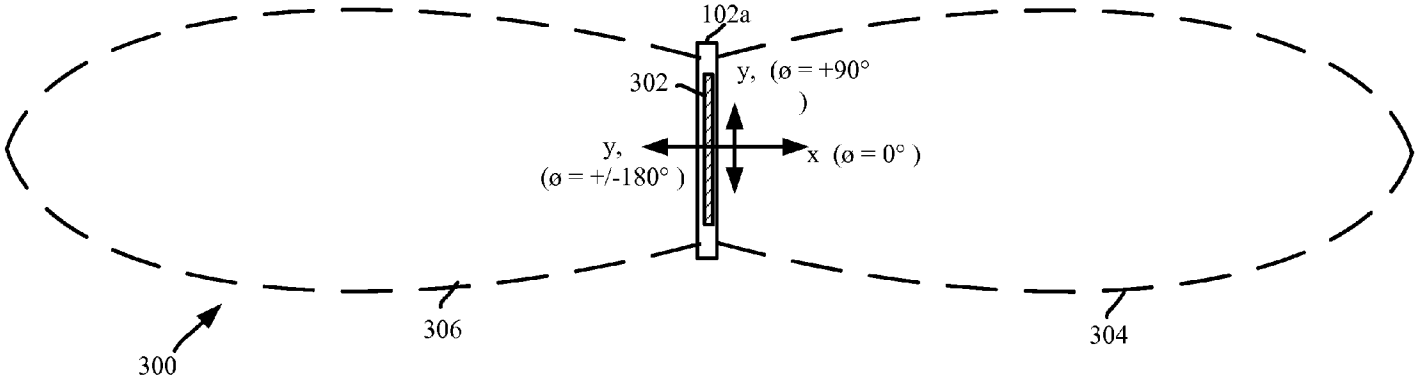
FIGS. 3 and 4 are drawings which are useful for understanding a main field and a back-field of antennas which are used in the EAS detection system of FIG. 1.
Figure 4:
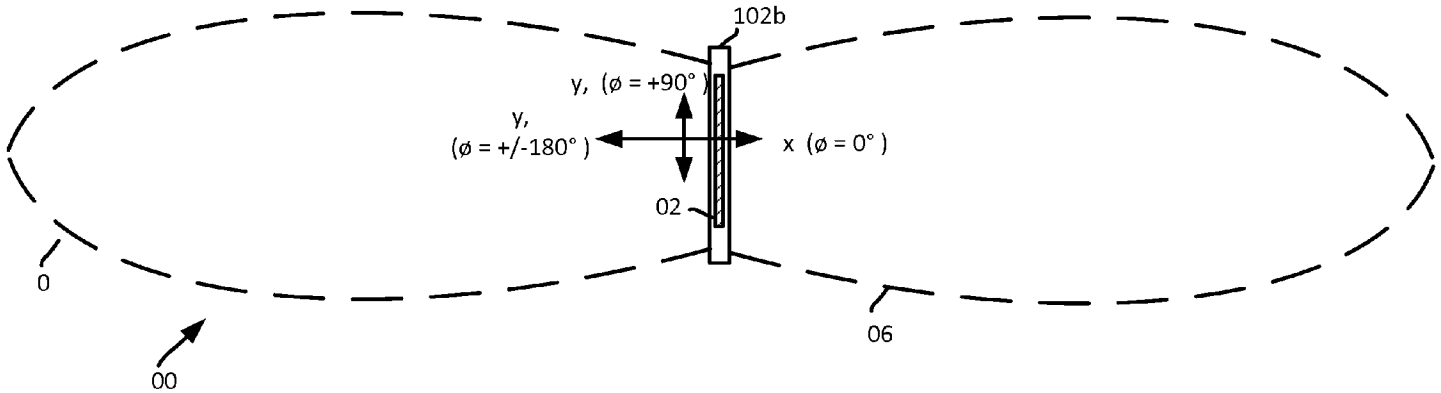

Referring now to FIGS. 3 and 4, there are shown exemplary antenna field patterns 300, 400 for antennas 302, 402 contained in pedestals 102*a*, 102*b*. As is known in the art, an antenna radiation pattern is a graphical representation of the radiating (or receiving) properties for a given antenna as a function of space. The properties of an antenna are the same in a transmit mode and a receive mode of operation. As such, the antenna radiation pattern shown is applicable for both transmit and receive operations as described herein. The exemplary antenna field patterns 300, 400 shown in FIGS. 3-4 are azimuth plane patterns representing the antenna pattern in the x, y coordinate plane. The azimuth pattern is represented in polar coordinate form and is sufficient for understanding the inventive arrangements. The azimuth antenna field patterns shown in FIGS. 3-4 are a useful way of visualizing the direction in which the antennas 302, 402 will transmit and receive signals at a particular transmitter power level.

Figure 5:
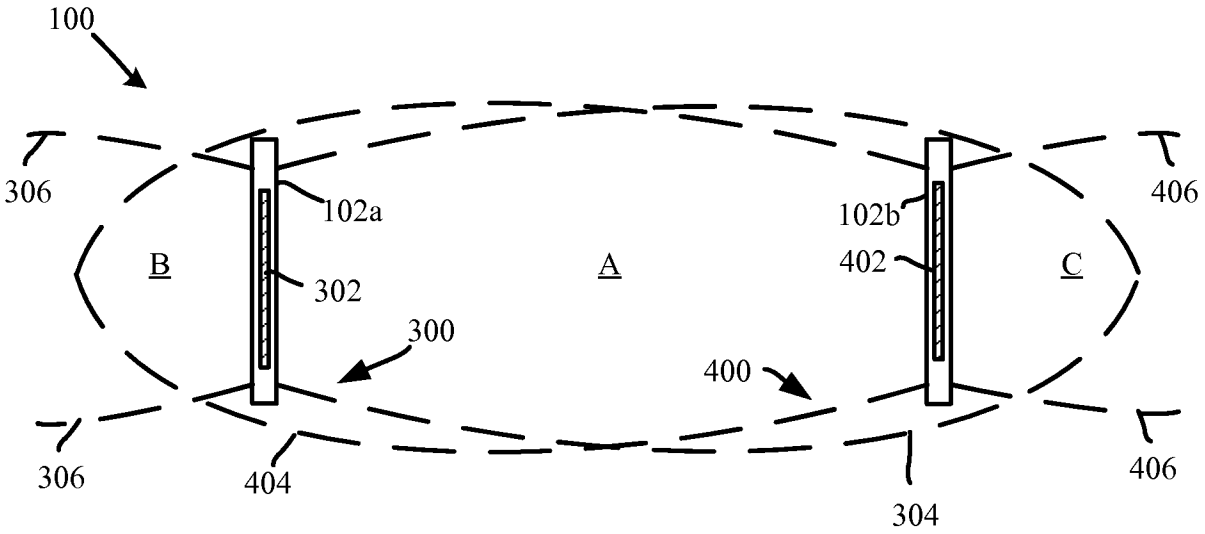
FIG. 5 is a drawing which is useful for understanding a detection zone in the EAS detection system of FIG. 1.

The antenna field pattern 300 shown in FIG. 3 includes a main lobe 304 with a peak at ø=0° and a back-field lobe 306 with a peak at angle ø=180°. Conversely, the antenna field pattern 400 shown in FIG. 4 includes a main lobe 404 with its peak at ø=180° and a back-field lobe 406 with a peak at angle ø=0°. In the EAS detection system 100, each pedestal 102*a*, 102*b* is positioned so that the main lobe of an antenna contained therein is directed into the EAS detection zone 150. Accordingly, a pair of pedestals 102*a*, 102*b* in the EAS detection system 100 will produce overlap in the antenna field patterns 300, 400, as shown in FIG. 5. Notably, the antenna field patterns 300, 400 shown in FIG. 5 are scaled for purposes of understanding the present invention. In particular, the patterns show the outer boundary or limits of an area in which an exciter signal of particular amplitude applied to antennas 302, 402 will produce a detectable response in an EAS security tag. However, it should be understood that a security tag within the bounds of at least one antenna field pattern 300, 400 will generate a detectable response when stimulated by an exciter signal.

The overlapping antenna field patterns 300, 400 in FIG. 5 will include an area A where there is overlap of main lobes 304, 404. However, it can be observed in FIG. 5 that there can also be some overlap of a main lobe of each pedestal with a back-field lobe associated with the other pedestal. For example, it can be observed that the main lobe 404 overlaps with the back-field lobe 306 within an area B. Similarly, the main lobe 304 overlaps with the back-field lobe 306 in an area C. Area A between pedestals 102*a*, 102*b* defines the EAS detection zone 150 in which active security tags should cause the EAS detection system 100 to generate an alarm response. Security tags in area A are stimulated by energy associated with an exciter signal within the main lobes 304, 404 and will produce a response which can be detected at each antenna. The response produced by a security tag in area A is detected within the main lobes of each antenna and processed in the system controller 110. Notably, a security tag in areas B or C will also be excited by the antennas 302, 402. The response signal produced by a security tag in these areas B and C will also be received at one or both antennas. This response signal is referred to herein as a "security tag signal".

Referring again to FIGS. 1-2, a plurality of proximity detectors (e.g., ultrasonic transducers) 108*a*, 108*b*, 108*c*, 108*d* is advantageously mounted on each pedestal 102*a* or 102*b*. Proximity sensors and ultrasonic transducers are well known in the art, and therefore will not be described herein. Still, it should be understood that each proximity sensor 108*a*, 108*b*, 108*c*, 108*d* is generally configured to detect the presence of a person and/or object located on a given side of a respective pedestal, as well as his/her/its distance from the same.

Accordingly, the proximity sensors 108*a*, 108*b*, 108*c*, 108*d* are arranged to point in both a front-field and a back-field of each respective pedestal 102*a*, 102*b*. As such, a first one of the proximity sensors points in a first direction shown by arrow 110, and thus detects persons located in the back-field of the respective pedestal. A second proximity sensor points in a second opposite direction shown by arrow 112, and therefore detects persons located in the front-field of the respective pedestal.

In the ultrasonic transducer scenario, each proximity sensor: generates high frequency sound waves; transmits the high frequency sound waves in a given direction; and receives echo signals from persons and/or objects located in range of the transmitted high frequency sound waves. Next, the system controller 110 determines a time interval between a first time at which a respective high frequency sound wave was transmitted from the proximity sensor and a second time at which the echo signal was received by the proximity sensor. The time interval is then used by the system controller 110 to determine the distance from a respective pedestal to the person/object based on the previously determined time interval. The determined distance is then used to control the EAS alarming circuit. For example, the determined distance may be used to inhibit an alarm issuance when the person and/or object is/are located in the back-field of and a certain distance from a pedestal 102*a* or 102*b*. By controlling the alarm issuance of the EAS detection system, false alarms caused by persons and/or objects located in the back-field of a pedestal will be significantly reduced as compared to that of conventional systems.

In most cases, only one person having possession of an active security tag will be located in proximity to the pedestals 102*a*, 102*b*. However, there are some scenarios in which two or more persons are located in proximity to the pedestals 102*a*, 102*b*. In this case, the distance information associated with one or both people is used to adaptively control alarm issuance of the EAS detection system, as will be described below.

Figure 6:
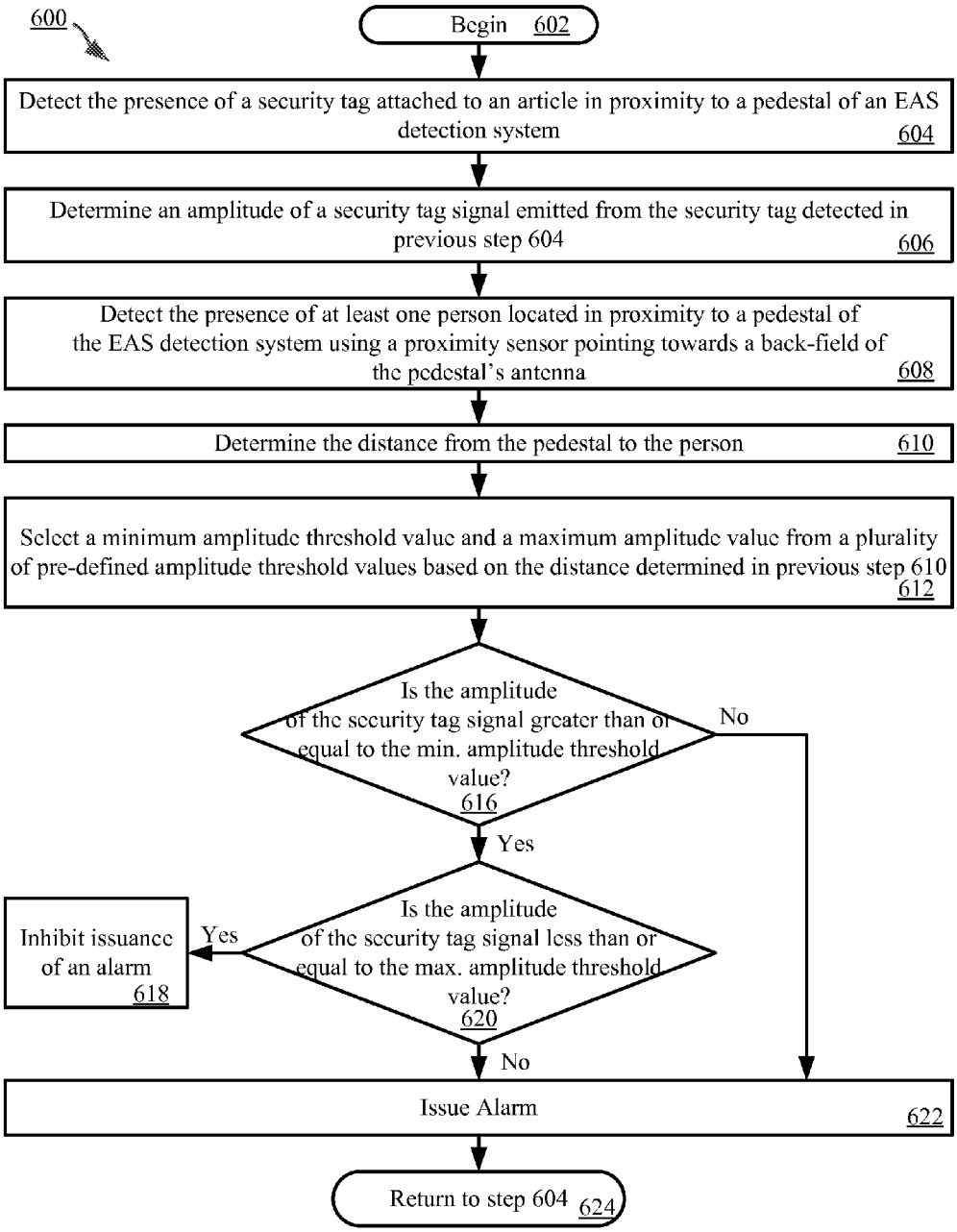
FIGS. 6-10 each provide a flowchart of an exemplary method for selectively adaptively controlling alarm issuance of an EAS detection system.

Referring now to FIG. 6, there is provided a flowchart of an exemplary method 600 for adaptively controlling alarm issuance of an EAS detection system. Method 600 applies to scenarios in which a proximity sensor 108*a* or 108*b* is disposed on a respective pedestal 102*a* or 102*b* so as to point in a direction towards a back-field of the pedestal's antenna. Notably, this method 600 can be employed even when a proximity sensor 108*c* or 108*d* is not disposed on the respective pedestal so as to point in a direction towards a front-field of the pedestal's antenna. Since the proximity sensor 108*a* or 108*b* detects the person's presence, an assumption can be made that the person resides in the back-field of the respective pedestal.

As shown in FIG. 6, method 600 begins with step 602 and continues with step 604. In step 604, the presence of a security tag is detected. The security tag is attached to an article in proximity to a pedestal (e.g., pedestal 102*a* or 102*b* of FIG. 1) of an EAS detection system (e.g., system 100 of FIGS. 1-2). An amplitude is then determined for a security tag signal emitted from the previously detected security tag, as shown by step 606.

Next in step 608, the presence of at least one person located in proximity to a pedestal (e.g., pedestal 102*a* or 102*b* of FIG. 1) of the EAS detection system is detected using a proximity sensor pointing towards a back-field of the pedestal's antenna. The distance is determined from the pedestal to the person in step 610. The determined distance value is then used in step 612 to select a minimum amplitude threshold value and a maximum amplitude threshold value from a plurality of pre-defined amplitude threshold values. These selected values facilitate a decision as to whether the amplitude of the security tag signal falls within a threshold range so as to indicate that the detected person possesses the security tag with a relatively high degree of probability. Accordingly, the method 600 continues with decision steps 616 and 620 to determine if the amplitude is greater than or equal to the minimum amplitude threshold value, or less than or equal to the maximum amplitude threshold value.

If the amplitude is nor greater than or equal to the minimum amplitude threshold value [616:NO], then step 622 is performed where an alarm is issued. If the amplitude is greater than or equal to the minimum amplitude threshold value [616:YES], then method 600 continues with decision step 620.

If the amplitude is less than or equal to the maximum amplitude threshold value [620:YES], then step 618 is performed where the alarm issuance is inhibited. In contrast, if the amplitude is greater than the maximum amplitude threshold value [620:NO], then step 622 is performed where the alarm is issued. Thereafter, method 600 returns to step 604, as shown by step 624.

Notably, the present invention is not limited to the criteria employed in steps 612-620 FIG. 6 for making a determination as to whether an alarm issuance needs to be inhibited. Accordingly, FIG. 7 is provided which shows a method employing alternative criteria than that used in FIG. 6.

Figure 7:
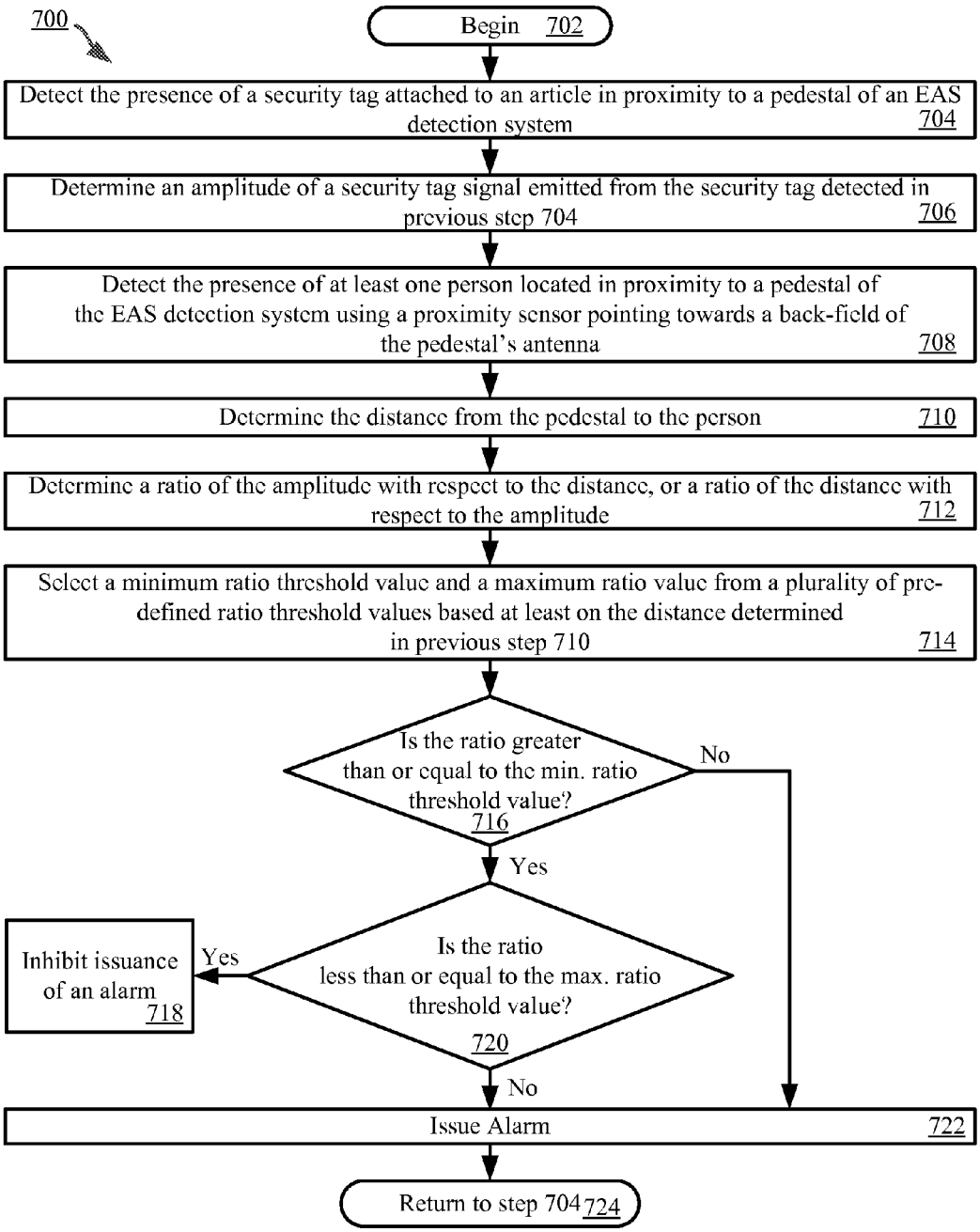

Referring now to FIG. 7, method 700 begins with step 702 and continues with step 704 where the presence of a security tag is detected. The security tag is attached to an article in proximity to a pedestal (e.g., pedestal 102*a* or 102*b* of FIG. 1) of an EAS detection system (e.g., system 100 of FIGS. 1-2). An amplitude is then determined for a security tag signal emitted from the previously detected security tag, as shown by step 706.

Next in step 708, the presence of at least one person located in proximity to a pedestal (e.g., pedestal 102*a* or 102*b* of FIG. 1) of the EAS detection system is detected using a proximity sensor pointing towards a back-field of the pedestal's antenna. The distance is determined from the pedestal to the person in step 710. The determined distance value is then used in steps 712-714 to: determine a ratio of the amplitude with respect to the distance, or a ratio of the distance with respect to the amplitude; and select a minimum ratio threshold value and a maximum ratio threshold value from a plurality of pre-defined ratio threshold values. These selected values facilitate a decision as to whether the determined ratio falls within a threshold range so as to indicate that the detected person possesses the security tag with a relatively high degree of probability. Accordingly, the method 700 continues with decision steps 716 and 720 to determine if the determined ratio is greater than or equal to the minimum ratio threshold value, or less than or equal to the maximum ratio threshold value.

If the determined ratio is not greater than or equal to the minimum ratio threshold value [716:NO], then step 722 is performed where an alarm is issued. If the determined ratio is greater than or equal to the minimum amplitude threshold value [716:YES], then method 700 continues with decision step 720.

If the determined ratio is less than or equal to the maximum ratio threshold value [720:YES], then step 718 is performed where the alarm issuance is inhibited. In contrast, if the determined ratio is greater than the maximum ratio threshold value [720:NO], then step 722 is performed where the alarm is issued. Thereafter, method 700 returns to step 704, as shown by step 724.

Figure 8A:
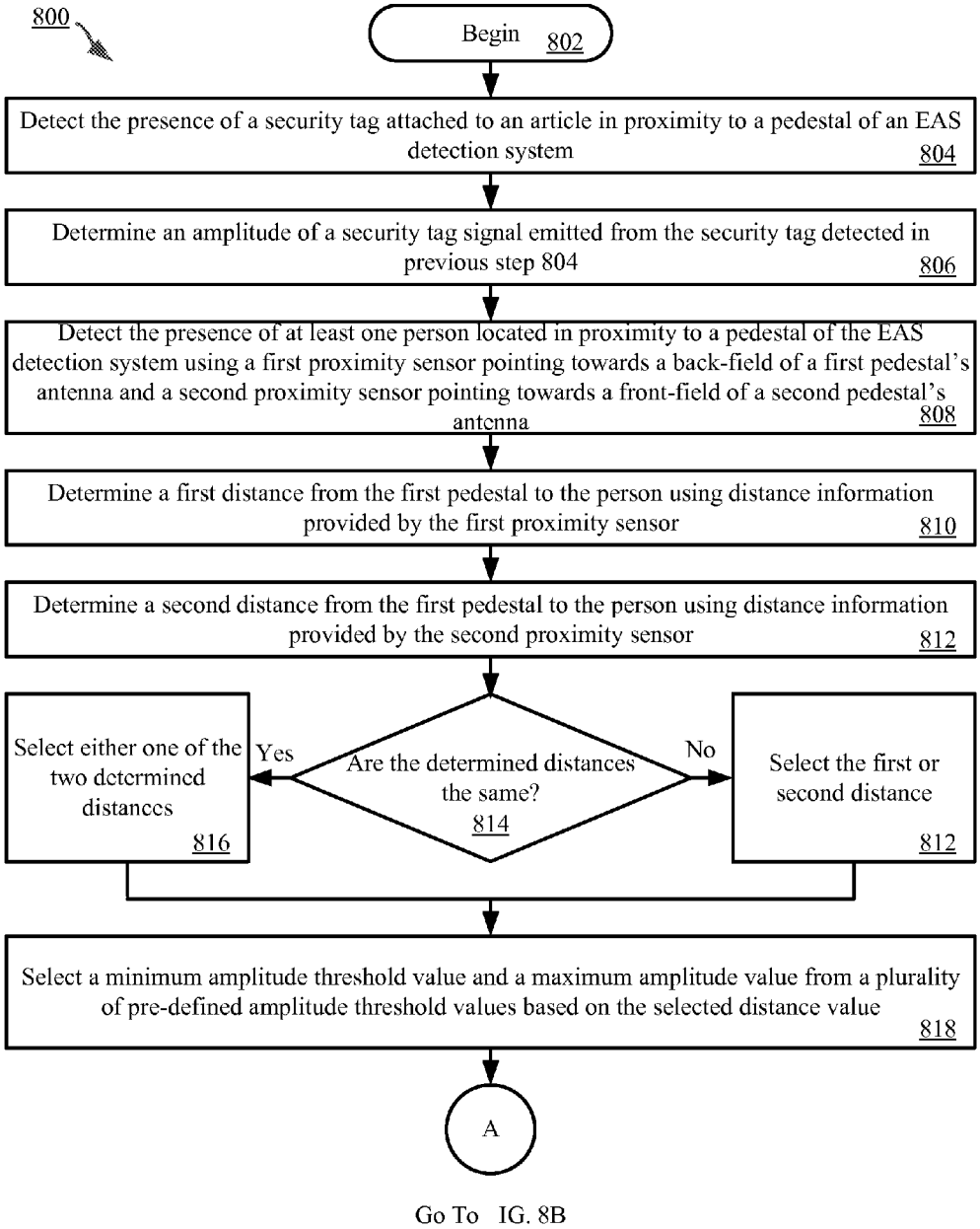
Figure 8B:
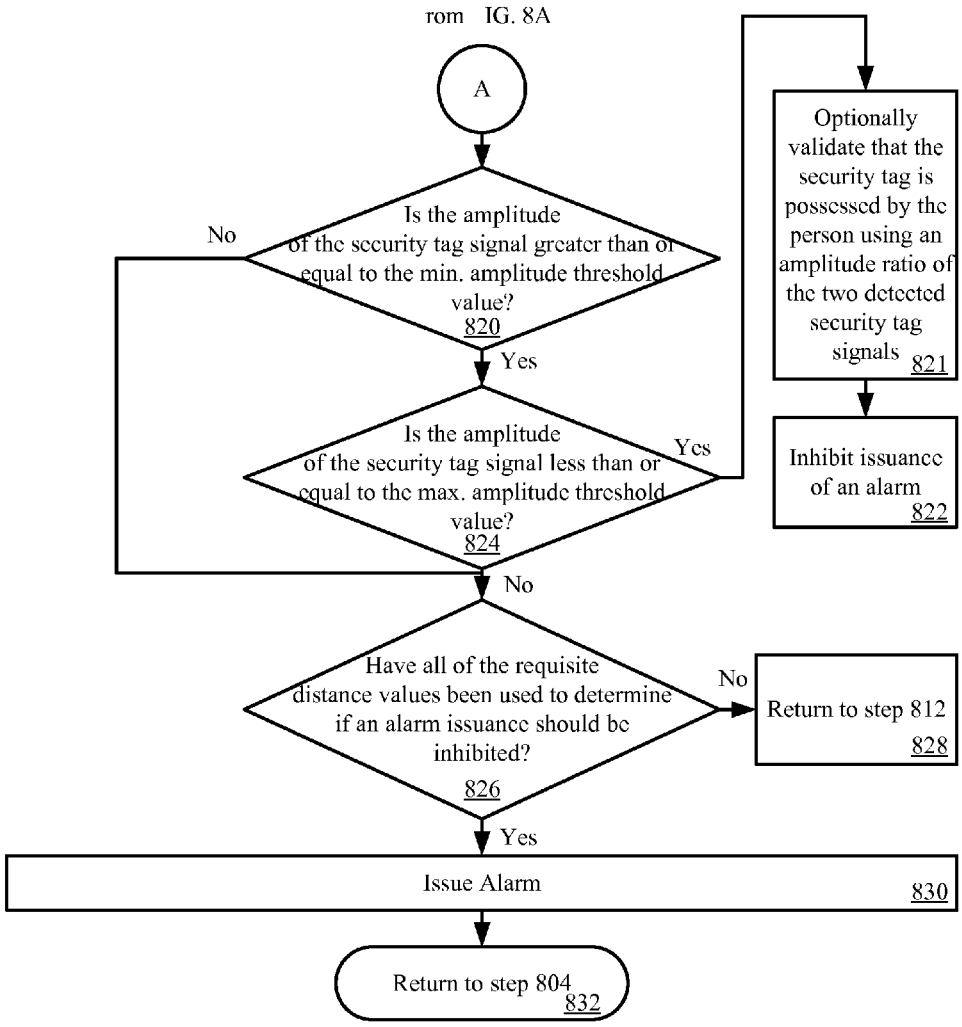

Referring now to FIGS. 8A-8B, there is provided a flowchart of an exemplary method 800 for adaptively controlling alarm issuance of an EAS detection system. Method 800 applies to scenarios in which a proximity sensor 108*a* or 108*b* is disposed on a first respective pedestals 102*a* or 102*b* so as to point in a direction of a back-field thereof, and a proximity sensor 108*c* or 108*d* is disposed a second respective pedestal 102*a* or 102*b* so as to point in a direction of the front-field thereof. For example, method 800 covers the scenario in which the proximity sensors 108*a*/108*d* or 108*b*/108*c* detect the presence of a person located in proximity to the two pedestals 102*a* and 102*b*.

As shown in FIG. 8, method 800 begins with step 802 and continues with step 804. In step 804, the presence of a security tag is detected. The security tag is attached to an article in proximity to a pedestal (e.g., pedestal 102*a* or 102*b* of FIG. 1) of an EAS detection system (e.g., system 100 of FIGS. 1-2). An amplitude is then determined for a security tag signal emitted from the previously detected security tag, as shown by step 806.

Next in step 808, the presence of at least one person located in proximity to a pedestal (e.g., pedestal 102*a* or 102*b* of FIG. 1) of the EAS detection system is detected using a first proximity sensor pointing towards a back-field of a first pedestal's antenna and a second proximity sensor pointing towards a front-field of a second pedestal's antenna. A first distance is then determined in step 810 from the first pedestal to the person using the distance information provided by the first proximity sensor. Similarly in step 812, a second distance is determined from the first pedestal to the person using distance information provided by the second proximity sensor.

If the first and second determined distances are the same [814:YES], then step 816 is performed where either one of the two determined distances is selected. Thereafter, step 818 is performed which will be discussed below. In contrast, if the first and second determined distances are not the same [814: NO], then the first or second determined distance is selected in step 812. Step 812 is followed by step 818. In step 818, a minimum amplitude threshold value and a maximum amplitude threshold value is selected from a plurality of pre-defined amplitude threshold values based on the selected distance value. Upon completing step 818, method 800 continues with decision steps 820 and 824 of FIG. 8B. Decision steps 820 and 824 are performed to determine whether or not the amplitude of the security tag signal falls within an expected range for a person located a certain distance from a given pedestal.

If the amplitude of the security tag signal is not greater than or equal to the minimum amplitude threshold value [820: NO], then step 826 is performed which will be described below. In contrast, if the amplitude of the security tag signal is greater than or equal to the minimum amplitude threshold value [820:YES], then decision step 824 is performed to determine if the amplitude of the security tag signal is less than or equal to the maximum amplitude threshold value.

If the amplitude of the security tag signal is less than or equal to the maximum amplitude threshold value [824:YES], then steps 821 and 822 are performed. Step 821 involves performing optional validation operations. The validation involves validating that the security tag is possessed by the person. Such validating is achieved using an amplitude ratio of the two detected security tag signals. For example, if the person is located closer to a first pedestal (e.g., pedestal 102*a* of FIG. 1) as compared to a second pedestal (e.g., pedestal 102*b* of FIG. 1), then the amplitude ratio should reflect that the amplitude of the security tag signal detected by the first pedestal is larger than the amplitude of the security tag signal detected by the second pedestal. When it is validated that the security tag is possessed by the person, then step 822 is performed where issuance of an alarm is inhibited.

If the amplitude value of the security tag falls outside the specified range of amplitudes [820, 824:NO], then method 800 continues with decision step 826. In step 826, a determination is made as to whether or not all of the requisite distance values have been used to determine if an alarm issuance should be inhibited. If no [826:NO], then method 800 returns to step 812 where the other distance value is selected, as shown by step 828. If yes [826:YES], then method 800 continues with steps 830 and 832. Step 830 involves issuing an alarm. Step 832 involves returning to step 804.

Notably, the present invention is not limited to the criteria-based process performed in steps 818-830 for determining if issuance of an alarm should be inhibited. For example, the criteria-based process of steps 818-830 can be replaced with the criteria-based process described in relation to steps 712-722 of FIG. 7. A person skilled in the art would readily appreciate that the criteria-based process described in relation to steps 712-722 might need some slight modification in order to be implemented by a method similar to that of method 800. Such modifications are within the scope of the present invention.

Figure 9:
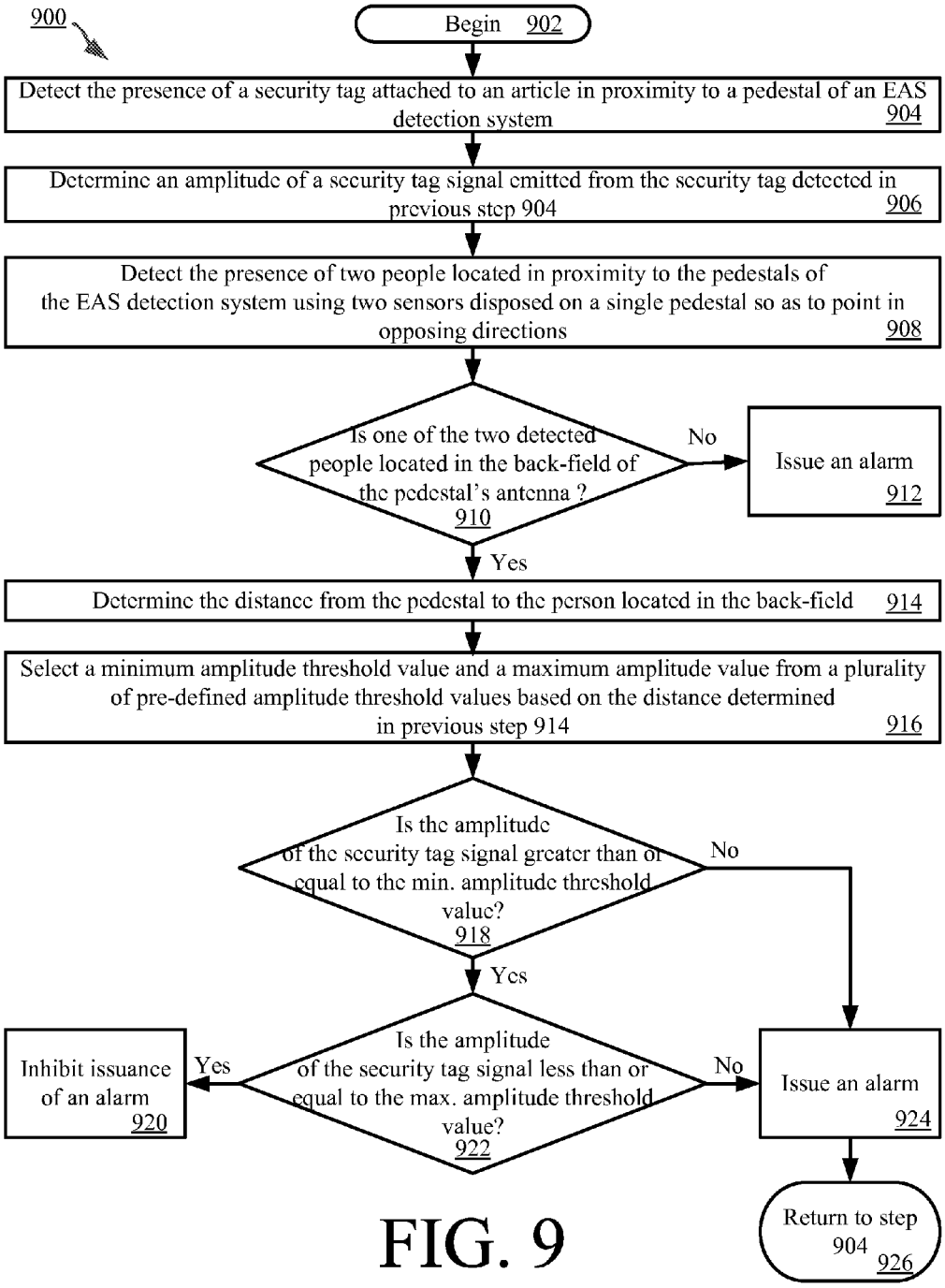

Referring now to FIG. 9, there is provided a flow diagram of an exemplary method 900 for adaptively controlling alarm issuance of an EAS detection system. Method 900 applies to scenarios in which two people are detected in proximity to the pedestals of the EAS detection system. For example, method 900 can be used where two sensors are disposed on a single pedestal so as to point in opposing directions, and each sensor detects the presence of a different person.

As shown in FIG. 9, method 900 begins with step 902 and continues with step 904. In step 904, the presence of a security tag is detected. The security tag is attached to an article in proximity to a pedestal (e.g., pedestal 102*a* or 102*b* of FIG. 1) of an EAS detection system (e.g., system 100 of FIGS. 1-2). An amplitude is then determined for a security tag signal emitted from the previously detected security tag, as shown by step 906.

Next in step 908, the presence of two people located in proximity to a pedestal (e.g., pedestal 102*a* or 102*b* of FIG. 1) of the EAS detection system is detected using two proximity sensors disposed on a single pedestal so as to point in opposing directions. Once the two people's presence has been detected, a decision is made as to whether one of the two detected people is located in the back-field of one of the pedestals. If not [910:NO], then an alarm is issued. In contrast, if so [910:YES], then in step 914 the distance from the pedestal to the person located in the back-field is determined. A minimum amplitude threshold value and a maximum threshold value are selected from a plurality of pre-defined amplitude threshold values based on the determined distance value, as shown by step 916.

If the amplitude of the security tag signal falls within the specified range defined by the minimum and maximum amplitude threshold values [918, 922:YES], then step 920 is performed in which an alarm issuance is inhibited. In contrast, if the amplitude of the security tag signal falls outside of the specified range defined by the minimum and maximum amplitude threshold values [918, 922:NO], then step 924 is performed where an alarm is issued. Thereafter, step 926 is performed where method 900 returns to step 904.

Notably, the present invention is not limited to the criteria-based process performed in steps 916-924 for determining if issuance of an alarm should be inhibited. For example, the criteria-based process of steps 916-924 can be replaced with the criteria-based process described in relation to steps 712-722 of FIG. 7. A person skilled in the art would readily appreciate that the criteria-based process described in relation to steps 712-722 might need some slight modification in order to be implemented by a method similar to that of method 900. Such modifications are within the scope of the present invention.

Figure 10:
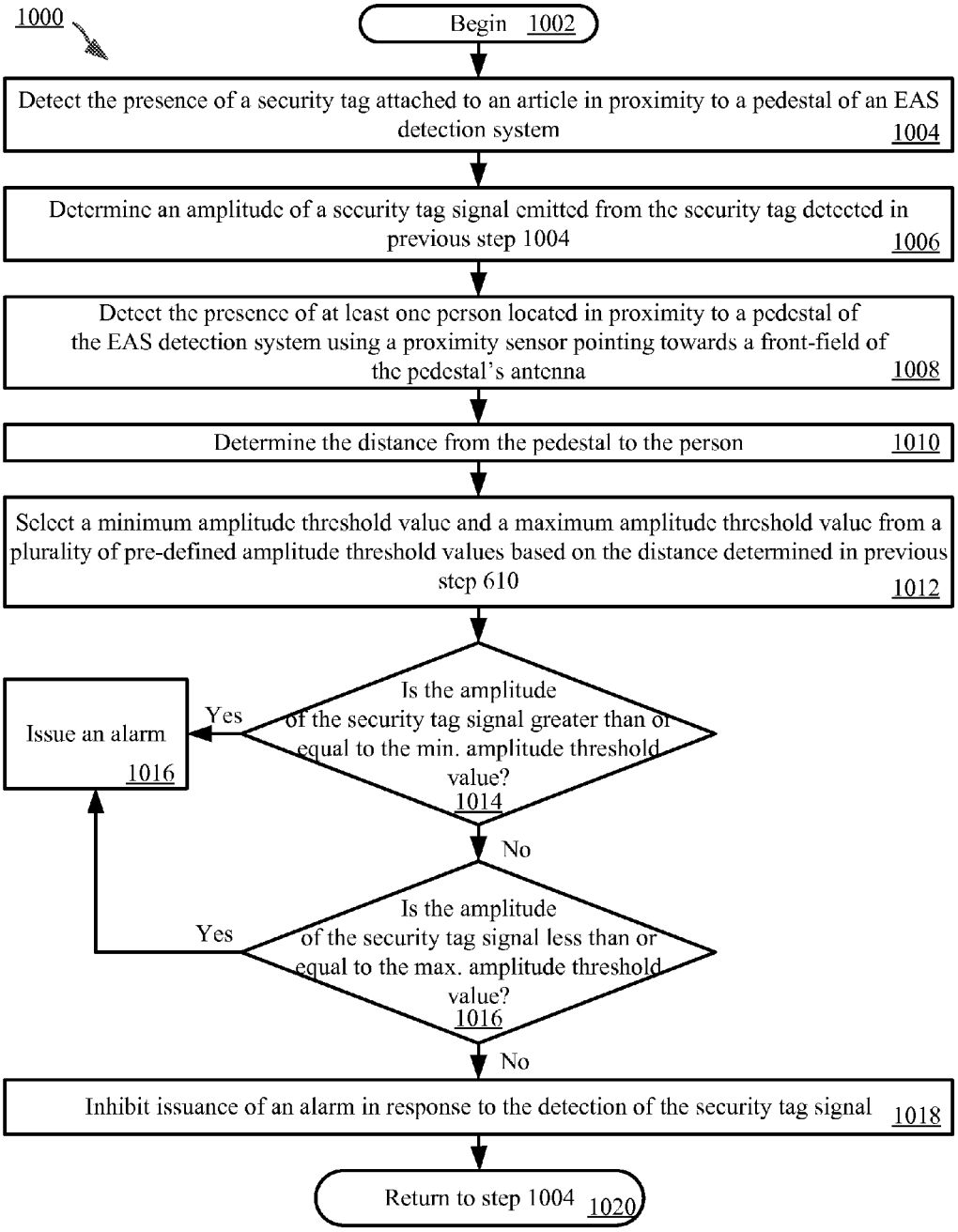

Referring now to FIG. 10, there is provided a flow diagram of an exemplary method 1000 for adaptively controlling alarm issuance of an EAS detection system. Method 1000 applies to scenarios in which a proximity sensor 108*c* or 108*d* is disposed on each pedestal 102*a*, 102*b* so as to point in a direction towards the front-fields thereof. For example, method 1000 covers the scenario in which the proximity sensors 108*c* and/or 108*d* detect the presence of a person located in proximity to the pedestals 102*a* and 102*b*.

As shown in FIG. 10, method 1000 begins with step 1002 and continues with step 1004. In step 1004, the presence of a security tag is detected. The security tag is attached to an article in proximity to a pedestal (e.g., pedestal 102*a* or 102*b* of FIG. 1) of an EAS detection system (e.g., system 100 of FIGS. 1-2). An amplitude is then determined for a security tag signal emitted from the previously detected security tag, as shown by step 1006.

Next in step 1008, the presence of at least one person located in proximity to a pedestal (e.g., pedestal 102*a* or 102*b* of FIG. 1) of the EAS detection system is detected using at least one proximity sensor disposed on a respective pedestal so as to point towards a front-field thereof. The distance from the pedestal to the person is then determined in step 1010. The determined distance is used to select minimum and maximum amplitude threshold values, as shown by step 1012.

Upon completing step 1012, decision steps 1014 and 1016 are performed to determine if the amplitude of the security tag signal falls within an expected amplitude range defined by the selected minimum and maximum amplitude threshold values. If the amplitude of the security tag signal does fall within an expected amplitude range [1014, 1016:YES], then step 1016 is performed in which an alarm is issued. In contrast, if the amplitude of the security tag signal does not fall within an expected amplitude range [1014, 1016:NO], then issuance of the alarm is inhibited, as shown by step 1018. Subsequently, step 1020 is performed where method 1000 returns to step 1004.

Figure 11:
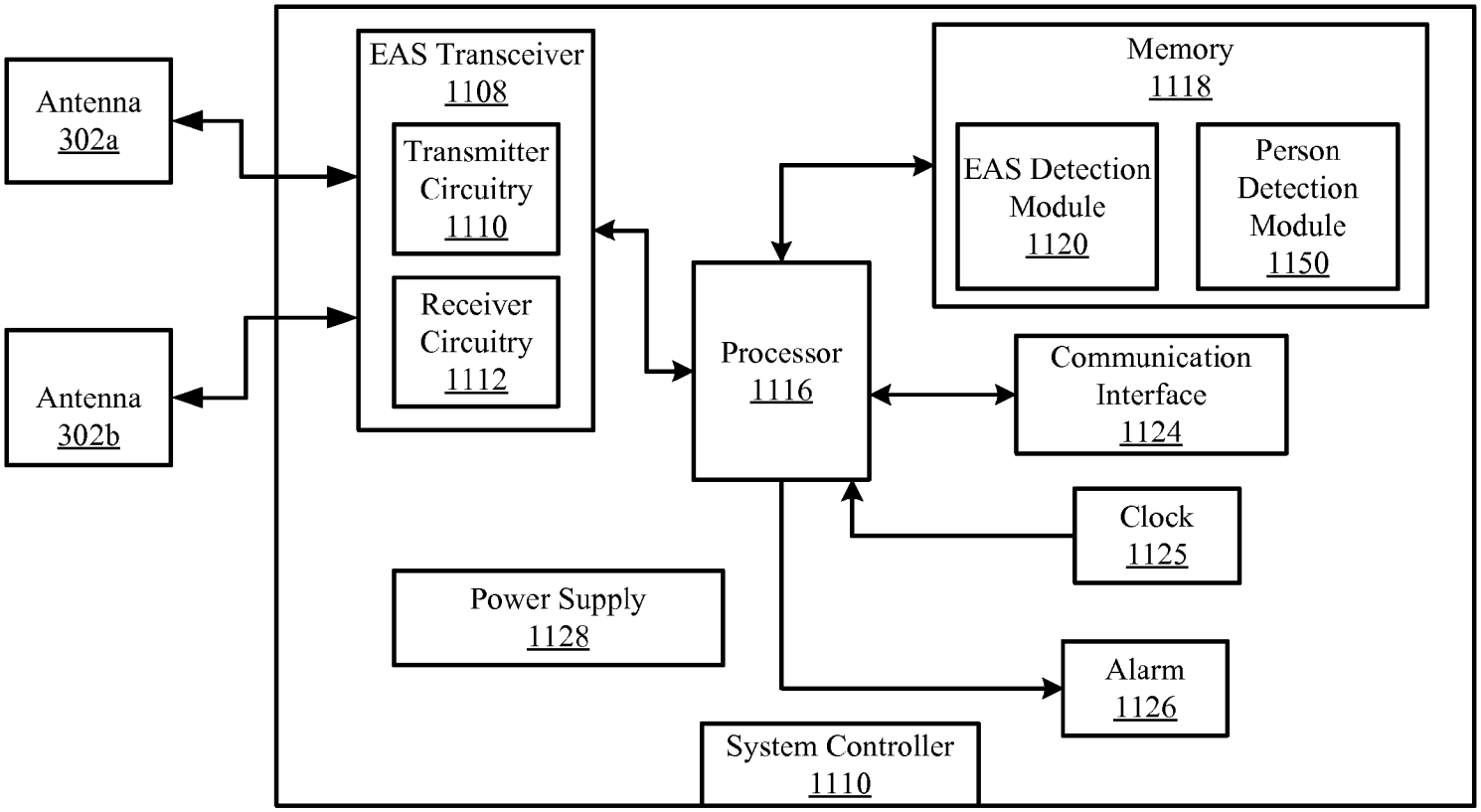
FIG. 11 is a block diagram that is useful for understanding an arrangement of an EAS controller which is used in the EAS detection system of FIG. 1.

Referring now to FIG. 11, there is provided a block diagram that is useful for understanding the arrangement of the system controller 110. The system controller comprises a processor 1116 (such as a micro-controller or Central Processing Unit ("CPU")). The system controller also includes a computer readable storage medium, such as memory 1118 on which is stored one or more sets of instructions (e.g., software code) configured to implement one or more of the methodologies, procedures or functions described herein. The instructions (i.e., computer software) can include an EAS detection module 1120 to facilitate EAS detection and perform methods for selectively issuing an alarm based on a detected location of an EAS security tag, as described herein. The instructions can also include a person detection module 1150 to facilitate the detection of persons located in proximity to a pedestal, the determination of the distance from the pedestal to the person, and adaptive control of alarm issuance based on the distance determination. These instructions can also reside, completely or at least partially, within the processor 1116 during execution thereof.

The system also includes at least one EAS transceiver 1108, including transmitter circuitry 1110 and receiver circuitry 1112. The transmitter and receiver circuitry are electrically coupled to antenna 302 and the antenna 402. A suitable multiplexing arrangement can be provided to facilitate both receive and transmit operation using a single antenna (e.g. antenna 302 or 402). Transmit operations can occur concurrently at antennas 302, 402 after which receive operations can occur concurrently at each antenna to listen for marker tags which have been excited. Alternatively, transmit operations can be selectively controlled as described herein so that only one antenna is active at a time for transmitting security tag exciter signals for purposes of executing the various algorithms described herein. The antennas 302, 402 can include an upper and lower antenna similar to those shown and described with respect to FIG. 1. Input exciter signals applied to the upper and lower antennas can be controlled by transmitter circuitry 1110 or processor 1116 so that the upper and lower antennas operate in a phase aiding or a phase opposed configuration as required.

Additional components of the system controller 110 can include a communication interface 1124 configured to facilitate wired and/or wireless communications from the system controller 110 to a remotely located EAS system server. The system controller can also include a real-time clock, which is used for timing purposes, an alarm 1126 (e.g. an audible alarm, a visual alarm, or both) which can be activated when an active EAS security tag is detected within the EAS detection zone 108. A power supply 1128 provides necessary electrical power to the various components of the system controller 110. The electrical connections from the power supply to the various system components are omitted in FIG. 11 so as to avoid obscuring the invention.

Those skilled in the art will appreciate that the system controller architecture illustrated in FIG. 11 represents one possible example of a system architecture that can be used with the present invention. However, the invention is not limited in this regard and any other suitable architecture can be used in each case without limitation. Dedicated hardware implementations including, but not limited to, application-specific integrated circuits, programmable logic arrays, and other hardware devices can likewise be constructed to implement the methods described herein. It will be appreciated that the apparatus and systems of various inventive embodiments broadly include a variety of electronic and computer systems. Some embodiments may implement functions in two or more specific interconnected hardware modules or devices with related control and data signals communicated between and through the modules, or as portions of an application-specific integrated circuit. Thus, the exemplary system is applicable to software, firmware, and hardware implementations.

Although the invention has been illustrated and described with respect to one or more implementations, equivalent alterations and modifications will occur to others skilled in the art upon the reading and understanding of this specification and the annexed drawings. In addition, while a particular feature of the invention may have been disclosed with respect to only one of several implementations, such feature may be combined with one or more other features of the other implementations as may be desired and advantageous for any given or particular application. Thus, the breadth and scope of the present invention should not be limited by any of the above described embodiments. Rather, the scope of the invention should be defined in accordance with the following claims and their equivalents.

What is claimed is:

1. A method for adaptively controlling alarm issuance in an Electronic Article Surveillance ("EAS") detection system, comprising:

detecting the presence of a first person located in proximity to a first pedestal of the EAS detection system using a first proximity sensor disposed on the first pedestal;

determining a first distance value representing a distance from the first pedestal to the first person whose presence was previously detected using distance information obtained from the first proximity sensor;

using the first distance value to select a criteria for use in determining whether the alarm issuance should be inhibited; and adaptively controlling the alarm issuance if the criteria which was previously selected is met based at least on a first amplitude of a security tag signal received at the first pedestal.

2. The method according to claim 1, wherein the criteria comprises an expected range of values for the first amplitude of the security tag signal emitted from a security tag located about the same distance from the first pedestal as the first person.

3. The method according to claim 2, wherein the first distance value is used to select a minimum amplitude threshold value and a maximum amplitude threshold value from a plurality of pre-defined amplitude threshold values.

4. The method according to claim 3, wherein the criteria is met when the first amplitude of the security tag signal is (1) greater than or equal to the minimum amplitude threshold value and (2) less than or equal to the maximum amplitude threshold value.

5. The method according to claim 1, wherein the criteria comprises an expected range of values for (1) a ratio between the first amplitude and the first distance, or (2) a ratio between the first amplitude and a second amplitude of the security tag signal received at a second pedestal of the EAS detection system.

6. The method according to claim 5, wherein the first distance value is used to select a minimum ratio threshold value and a maximum ratio threshold value from a plurality of pre-defined ratio threshold values.

7. The method according to claim 6, wherein the criteria is met when a ratio is (1) greater than or equal to the minimum ratio threshold value and (2) less than or equal to the maximum ratio threshold value.

8. The method according to claim 1, further comprising:

detecting the presence of the first person located in proximity to a second pedestal of the EAS detection system using a second proximity sensor disposed on the second pedestal;

determining a second distance value representing a distance from the first pedestal to the first person whose presence was previously detected using distance information obtained from the second proximity sensor; and selecting either the first or second distance value when the first and second distance values are the same, or select one of the first and second distance values when the first and second distance values are not the same;

wherein the criteria is selected using the first or second distance value which was previously selected.

9. The method according to claim 1, further comprising validating that the security tag is possessed by the first person using an amplitude ratio between the first amplitude and a second amplitude of the security tag signal received at a second pedestal of the EAS detection system.

10. The method according to claim 1, further comprising:

detecting the presence of a second person located in proximity to the first pedestal of the EAS detection system using a second proximity sensor disposed on the first pedestal;

determining whether at least one of the first person and the second person is located in a back-field of the first pedestal's antenna; and using distance information associated with the first or second person which was determined to be located in the back-field of the first pedestal's antenna to adaptively control the alarm issuance.

11. An Electronic Article Surveillance ("EAS") detection system, comprising:

a first pedestal;

a first proximity sensor disposed on the first pedestal and detecting the presence of a first person located in proximity to the first pedestal;

a system controller communicatively coupled to the first proximity sensor and determining a first distance value representing a distance from the first pedestal to the first person using distance information obtained from the first proximity sensor, using the first distance value to select a criteria for use in determining whether the alarm issuance should be inhibited, and adaptively controlling the alarm issuance if the criteria is met based at least on a first amplitude of a security tag signal received at the first pedestal.

12. The EAS detection system of claim 11, wherein the criteria comprises an expected range of values for the first amplitude of the security tag signal emitted from a security tag located about the same distance from the first pedestal as the first person.

13. The EAS detection system of claim 12, wherein the first distance value is used to select a minimum amplitude threshold value and a maximum amplitude threshold value from a plurality of pre-defined amplitude threshold values.

14. The EAS detection system of claim 13, wherein the criteria is met when the first amplitude of the security tag signal is (1) greater than or equal to the minimum amplitude threshold value and (2) less than or equal to the maximum amplitude threshold value.

15. The EAS detection system of claim 11, wherein the criteria comprises an expected range of values for a ratio between the first amplitude and a second amplitude of the security tag signal received at a second pedestal of the EAS detection system.

16. The EAS detection system of claim 15, wherein the first distance value is used to select a minimum ratio threshold value and a maximum ratio threshold value from a plurality of pre-defined ratio threshold values.

17. The EAS detection system of claim 16, wherein the criteria is met when a ratio between the first and second amplitudes is (1) greater than or equal to the minimum ratio threshold value and (2) less than or equal to the maximum ratio threshold value.

18. The EAS detection system of claim 11, wherein the system controller further detects the presence of the first person located in proximity to a second pedestal of the EAS detection system using a second proximity sensor disposed on the second pedestal, determines a second distance value representing a distance from the first pedestal to the first person whose presence was previously detected using distance information obtained from the second proximity sensor, and selects either the first or second distance value when the first and second distance values are the same, or select one of the first and second distance values when the first and second distance values are not the same;

wherein the criteria is selected using the first or second distance value which was previously selected.

19. The EAS detection system of claim 11, wherein the system controller further validates that the security tag is possessed by the first person using an amplitude ratio between the first amplitude and a second amplitude of the security tag signal received at a second pedestal of the EAS detection system.

20. The EAS detection system of claim 11, wherein the system control further detects the presence of a second person located in proximity to the first pedestal of the EAS detection system using a second proximity sensor disposed on the first pedestal, determines whether at least one of the first person and the second person is located in a back-field of the first pedestal's antenna, and uses distance information associated with the first or second person which was determined to be located in the back-field of the first pedestal's antenna to adaptively control the alarm issuance.

* * * * *